United States Patent [19]

Del Rosario

[11] 4,333,199

[45] Jun. 8, 1982

[54] TOOTHBRUSH

[76] Inventor: Manuel Del Rosario, 6459 SW. 38 St., Miami, Fla. 33155

[21] Appl. No.: 259,258

[22] Filed: Apr. 30, 1981

Related U.S. Application Data

[63] Continuation of Ser. No. 123,660, Feb. 22, 1980, abandoned, which is a continuation-in-part of Ser. No. 13,384, Feb. 21, 1979, abandoned.

[51] Int. Cl.[3] ..... A46B 7/06

[52] U.S. Cl. ..... 15/167 R; 15/201; 15/172

[58] Field of Search ..... 15/167 R, 167 A, 172, 15/185, 201, 176, 144 A, 146

[56] References Cited

U.S. PATENT DOCUMENTS

| | | | |
|---|---|---|---|
| 896,123 | 8/1908 | Lewis | 15/146 X |
| 1,439,913 | 12/1922 | Saxe | 15/172 |
| 1,889,029 | 11/1932 | Anderson | 15/146 X |
| 1,968,303 | 7/1934 | McMath | 15/167 R |
| 2,122,619 | 7/1938 | McMath | 15/167 R |
| 2,707,293 | 5/1955 | Ferrer | 15/144 A X |
| 3,152,349 | 10/1964 | Brennesholtz | 15/201 X |
| 3,994,038 | 11/1976 | Moulet | 15/201 X |
| 4,020,521 | 5/1977 | Velasquez | 15/167 R X |

FOREIGN PATENT DOCUMENTS

| | | | |
|---|---|---|---|
| 531002 | 8/1931 | Fed. Rep. of Germany | 15/167 R |
| 1158936 | 7/1969 | United Kingdom | 15/201 |

*Primary Examiner*—Peter Feldman

*Attorney, Agent, or Firm*—John Cyril Malloy

[57] ABSTRACT

An improved toothbrush which includes an elongate handle and a brush with a base and a mounting in the form of a coil spring interconnecting the brush base to the distal end of the toothbrush for swinging, rotatable, tilting movement of the brush relative to the handle in use. Two embodiments are illustrated.

6 Claims, 8 Drawing Figures

TOOTHBRUSH

This is a continuation of application Ser. No. 123,660 filed Feb. 22, 1980, now abandoned.

Which is a continuation-in-part application of my copending patent application Ser. No. 013,384 filed on Feb. 21, 1979, now abandoned.

FIELD OF THE INVENTION

This invention relates to toothbrushes and, more particularly, to a toothbrush wherein the brush is mounted resiliently and yieldably for flexing action to the distal end of the handle.

BACKGROUND OF THE INVENTION

In the past there have been numerous types of mountings for brushes in toothbrush combinations. This invention is of an improved type of mounting in combination with a brush and toothbrush handle wherein the brush is adapted for rotatable and tilting movement, two embodiments being described.

OBJECTS OF THE INVENTION

It is an object of this invention to provide an improved mounting for toothbrushes and, more particularly, for mounting the toothbrush to the brush handle wherein a coiled spring is utilized and a clearance recess for a relatively large range of tilting and rotating action of the brush in use.

In accordance with these and other objects which will become apparent hereinafter, the instant invention will now be described with reference to the accompanying drawings, in which:

DESCRIPTION OF THE FIRST PREFERRED EMBODIMENT

Figure 1:
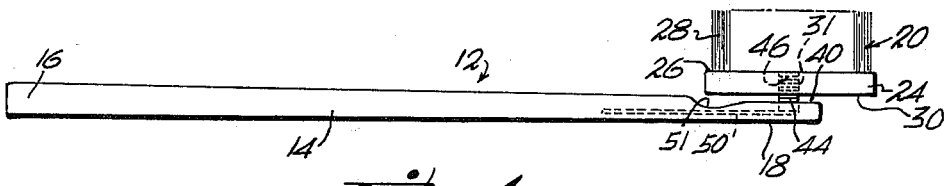
FIG. 1 is a side elevation view of a toothbrush in accordance with the first embodiment of this invention.
Figure 2:
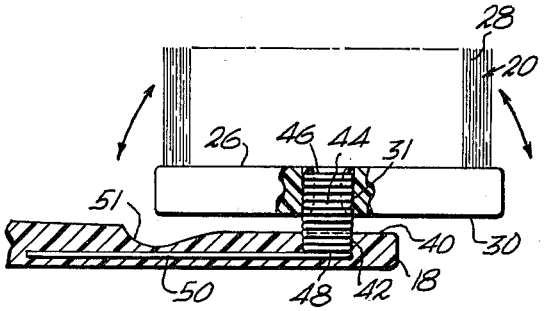
FIG. 2 is an enlarged view partly in cross section of the right-hand portion of FIG. 1.
Figure 3:
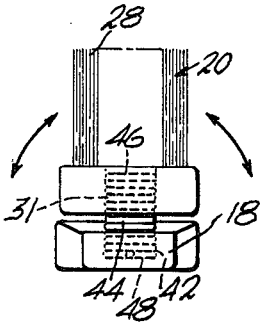
FIG. 3 is an end view of the device shown in FIG. 1.
Figure 4:
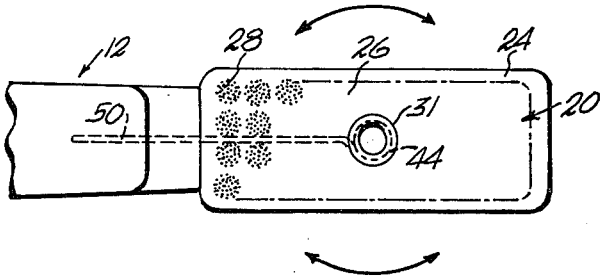
FIG. 4 is a top plan view of the device shown in FIGS. 1 and 2.
Figure 5:
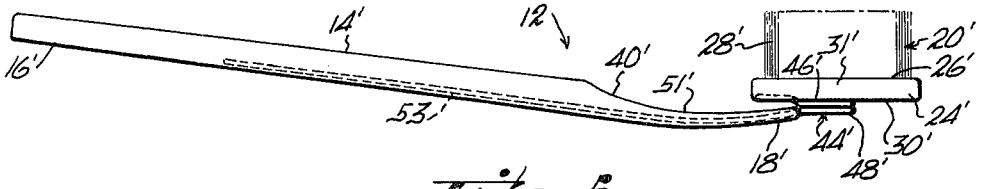
FIG. 5 is a side elevational view, similar to FIG. 1, in accordance with the second embodiment of the invention.
Figure 6:
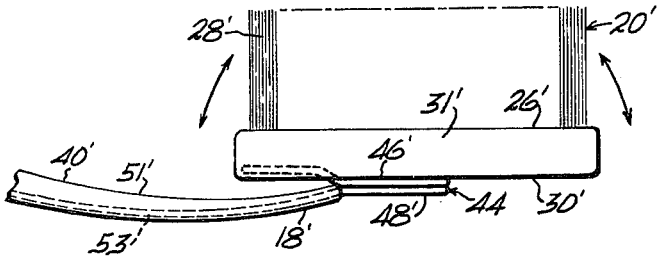
FIG. 6 is a fragmentary enlarged view of the right-hand portion of FIG. 5.
Figure 7:
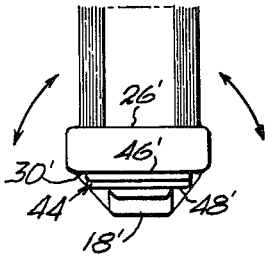
FIG. 7 is an end view of the device illustrated in FIGS. 1 and 2.
Figure 8:
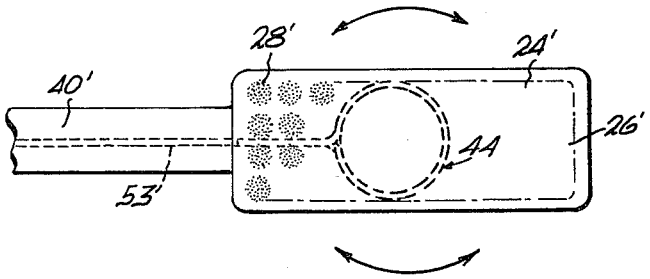
FIG. 8 is a top plan view of the device of FIGS. 1 and 2.

Referring to the drawings wherein like reference characters designate like or corresponding parts throughout the several views and referring particularly to FIG. 1, the toothbrush is generally designated by the numeral 12. It is seen that it has an elongate handle 14 with a proximal end zone 16 and a distal end zone 18. On the distal end zone a brush 20 is mounted spaced slightly inward, that is, adjacent the terminal end. The brush includes a base 24 of predetermined length and with an upper surface 26 from which an array of bristles 28 extend being secured to the base in upstanding relation. The brush base has a second surface 30 which faces toward the handle, that is oppositely from the surface from which the brushes extend. The brush base has a central recess 31 extending toward the surface from which the brushes extend. With respect to the handle, the distal end zone is provided with a recess 51 in the face 40. A coil spring 44 which has an upper end 46 and a lower end 48 is utilized to connect the brush to the handle in the manner shown. It is seen that the upper end is nested in the recess of the brush and fixed therein while the lower end of the spring is nested in the recess 42 of the distal end zone of the handle and secured therein. Additionally, the coil spring includes a portion which extends tangentially with respect to the coils of the springs longitudinally of and in an embedded relation in the distal end zone of the handle, this portion of the spring being designated by the numeral 50. The upper surface of the distal end zone is, additionally, provided with a recess 51 which is spaced from the spring mounting a distance about one-half of the distance from the spring mounting to the terminal end zone of the handle, that is, about one-half the longitudinal length of the brush. This is so that the base with the brushes is adapted for rotation about the axis of the spring and for tilting and rocking motion as is indicated in the drawings by the arrowed lines.

In use, it is seen that one brushing his teeth with the device will find that it will conform generally to the shape of the mouth and the teeth location of a user.

It will be seen that the longitudinally extending portion of the spring which is embedded in the handle rigidifies the distal end of the handle which would otherwise be substantially weakened by reason of the removal of the material to provide the clearance recess 51, so that a strong durable toothbrush is provided with the moving, tilting, rotating action described by the arrowed lines in the drawings.

DESCRIPTION OF THE SECOND PREFERRED EMBODIMENT

Referring now to the second preferred embodiment in the drawings, wherein similar reference characters are utilized corresponding to similar parts throughout the several views and with respect to the embodiment shown in FIGS. 1 through 4, with the exception that the numerals have been identified by a prime designation, the toothbrush is generally designated by the numeral 12'. It is seen that it has an elongate handle 14' with a proximal end zone 16' and a distal end zone 18'. On the distal end zone a brush 20' is mounted spaced slightly inward, that is, adjacent the terminal end. The brush includes a base 24' of predetermined length and with an upper surface 26' from which an array of bristles 28' extend being secured to the base in upstanding relation in a conventional manner. The brush base has an opposite surface 30' which faces toward the handle, that is, oppositely from the surface from which the brushes extend. The brush has a central zone 31' from which the bristle array extends. With respect to the handle, the distal end zone is provided with a recess 51' in the face 40', which recess is somewhat elongate, that is, having a generally longer radius of curvature than does the recess 51 of the first embodiment. A coil spring 44' which has an upper end 46' and a lower end 48' is utilized to connect the brush to the handle in the manner shown. It is seen that the upper end is secured to the brush and fixed thereto while the lower end of the spring is fixed to and carried by the distal end zone of the handle. Additionally, the coil spring includes a portion which extends from the coils of the spring longitudinally of and in an embedded relation in the distal end zone of the handle, this portion of the spring being designated by the numeral 53. It will be seen that the base with the brush is adapted for rotation about the axis of the spring and for tilting and rocking motion as is indicated in the drawings by the arrowed lines in the second embodiment as well as in the first embodiment.

In use, it is seen that one brushing his teeth with this device, irrespective of which embodiment is utilized, will find that it will conform generally to the shape of the mouth and the teeth location of the user and provide stimulation of the gums.

It will be seen that the longitudinally extending portion of the spring which is embedded in the handle rigidifies the distal end of the handle which would otherwise be substantially weakened by reason of the removal of the material to provide the clearance recess 51, so that a strong durable toothbrush is provided with the moving, tilting, rotating action described by the arrowed lines in the drawings.

While the instant invention has been shown and described in what are considered to be two practical and preferred embodiments, it is recognized that departures may be made within the spirit and scope of this invention which is, therefore, not to be limited except as set forth by the following claims within the doctrine of equivalents.

What is claimed is:

1. A toothbrush having an elongate handle with a proximal end zone and a distal end zone and including a brush mounted adjacent the distal end zone, said brush including a base of predetermined length and a first main surface and an array of bristles secured in upstanding relation to those and extending in a common direction for the first main surface, the brush base having a second main surface oppositely facing in relation to the first main surface and having a central recess extending toward the surface from which the brushes extend, said distal end zone of said handle having a first face with a recess in said first face confronting the second main surface of the brush base, a coil spring having an upper end and a lower end, said upper end being nested in the recess of said brush base and fixed therein to connect the brush to the handle and the lower end of said spring being nested in the recess of said distal end zone and being secured thereto; and said coil spring including a tangentially extending elongate portion said portion being embedded in the distal end zone and extending toward said proximal end, said upper surface of said distal end zone having a recess in the first face spaced in a direction toward the proximal end zone and from the recess in said distal end zone a distance of about one-half of said predetermined length of said base, whereby, said base with said brushes is adapted for rotation about the axis of said spring and for tilting and rocking motion, with said base being adapted to move in and out of said recess in the first face of the distal end zone of the handle in said rocking motion.

2. The device as set forth in claim 1 wherein said handle is of plastic material.

3. A toothbrush having an elongate handle with a longitudinally extending proximal end zone and a longitudinally extending distal end zone and including a brush mounted adjacent and in overlaying relation of the extending distal end zone, said brush including, a base of predetermined length, a first surface and an array of bristles secured to said base and extending in upstanding relation from the first surface, the brush base having a second surface oppositely facing in relation to the first surface, said distal end of said handle having a first longitudinally extending face confronting the second surface of the brush base, a coil spring having an upper end and a lower end, means connecting said upper end to the base and the lower end to the distal end zone of said handle.

4. The device as set forth in claim 3 wherein said coil spring includes an extending elongate portion, said portion being embedded in the distal end zone and extending toward said proximal end.

5. The device as set forth in claim 4 wherein said first face of said distal end zone is provided with a clearance recess in the first face spaced from said base in said distal end zone to a accommodate tilting movement of said base, whereby said base with said brush is adapted for rotation about the axis of said spring and for tilting and rocking motion, with said base being adapted to move in and out of said recess in the first face of the distal end zone of the handle in said rocking motion.

6. The device as set forth in claim 3 wherein said handle is of plastic material.

* * * * *